United States Patent [19]

Hill et al.

[11] Patent Number: 5,024,875

[45] Date of Patent: Jun. 18, 1991

[54] ANTIMICROBIAL MICROPOROUS COATING

[75] Inventors: Berlie R. Hill, Cana, Va.; Thomas F. Watson, Sr., Greensboro; Benny L. Triplett, Pleasant Garden, both of N.C.

[73] Assignee: Burlington Industries, Inc., Greensboro, N.C.

[21] Appl. No.: 905,135

[22] Filed: Sep. 9, 1986

[51] Int. Cl.[5] ..... B05D 3/10; B32B 5/18; B32B 5/20

[52] U.S. Cl. ..... 428/267; 427/246; 427/354; 428/315.5; 428/423.5; 428/907; 523/122

[58] Field of Search ..... 427/246, 354; 428/315.5, 423.5, 907, 267; 523/122

[56] References Cited

U.S. PATENT DOCUMENTS

| | | |
|---|---|---|
| 3,968,292 | 7/1976 | Pearman et al. . |
| 4,024,307 | 3/1977 | Brahm et al. . |
| 4,028,451 | 6/1977 | Warwicker . |
| 4,370,981 | 2/1983 | Sanderson . |
| 4,429,000 | 1/1984 | Naka et al. . |
| 4,460,369 | 7/1984 | Seymour . |
| 4,504,541 | 3/1985 | Yasuda et al. . |
| 4,507,413 | 3/1985 | Thoma et al. . |
| 4,554,198 | 11/1985 | von Blucher et al. . |

FOREIGN PATENT DOCUMENTS

| | | |
|---|---|---|
| 2367606 | 5/1978 | France . |
| 1597143 | 9/1981 | United Kingdom . |
| 2059872 | 9/1981 | United Kingdom . |

OTHER PUBLICATIONS

"Recent Developments in Coated Apparel", by Robert Lomax, pp. 91-99, *Journal of Coated Fabrics*, vol. 14, Oct. 1984.

"The Mechanism and Prevention of Microbial Attack on Polyurethane Coatings", by Dr. B. F. Sagar, Shirley Institute, Publ. S.41, 71-83, (1981).

Derwent Abstract of Published French application 7631247.

"Defensive Publication", published Aug. 1, 1972.

*International Dyer & Textile Printer*, article entitled, "Actifreshtreated Polyurethane", Jan. 6, 1978, p. 36.

*Textile World*, article entitled, "High-Performance Coatings and Finishes Expand Uses", May 1985, by Richard Mansfield, pp. 58-60.

PCT International Search Report.

Bayer Pocket Book for the Plastics Industry, 3rd Edition, pp. 63-119, (1963).

*Primary Examiner*—James O. Cannon

*Attorney, Agent, or Firm*—Nixon & Vanderhye

[57] ABSTRACT

Waterproof, moisture-vapor-permeable urethane-coated fabrics with durable antimicrobial properties that remain after repeated launderings are prepared by incorporating bioactive silyl quaternary ammonium salts into the polyurethane elastomer solvent solution that forms a microporous polyurethane layer by the wet coagulation method on a base fabric.

6 Claims, 1 Drawing

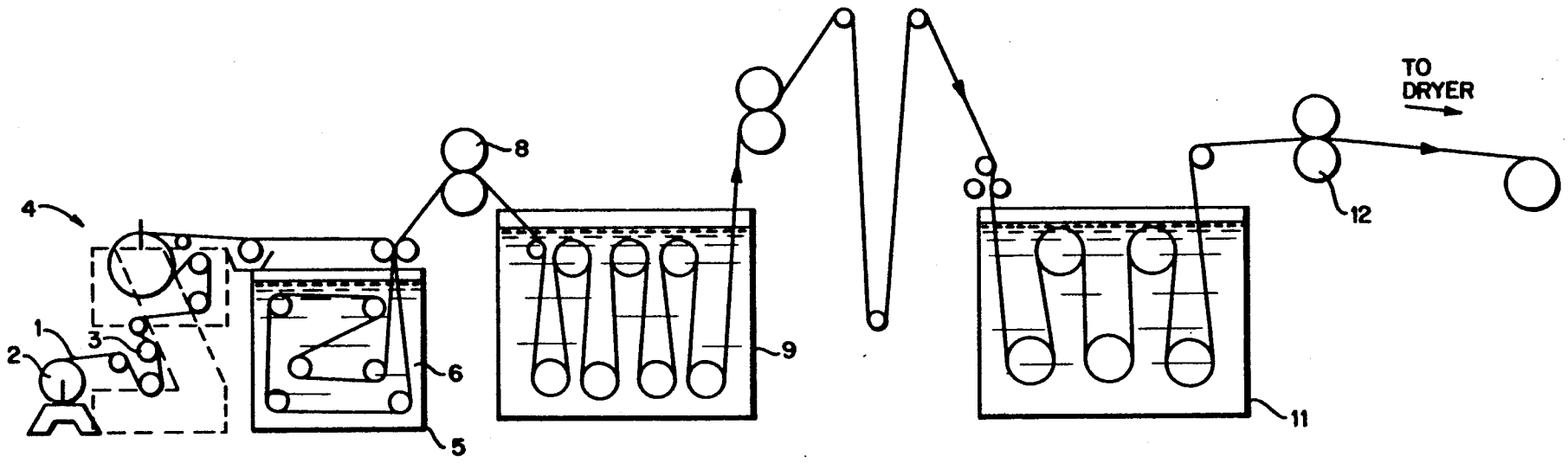
TO DRYER
12
11
9
8
6
5
4
3
1
2

ANTIMICROBIAL MICROPOROUS COATING

BACKGROUND OF THE INVENTION

This invention relates to a moisture-permeable waterproof coated fabric. More particularly, it is concerned with a moisture-permeable waterproof fabric having an antimicrobial microporous polymeric coating thereon, the fabric having good moisture-permeability with durable waterproofness and antimicrobial properties that remain characteristic of the fabric even following multiple launderings. Procedures for making such fabrics are also described.

Coated fabrics suitable for use as rainwear function by blocking the pores of a woven, knitted or non-woven fabric with a cohesive polymer film which acts as a physical barrier against wind, water, and in the case of protective workwear, aggressive chemicals, oils, and greases. This barrier or coating distinguishes polymer coatings from chemical finishes which merely coat the individual fibers of a fabric without blocking the pores, and repel fluids by surface tension effects. Polymeric coatings have been based upon, initially rubber or synthetic or fluorocarbon rubbers, and more recently, polyurethanes, acrylics, silicone elastomers and polyvinylchlorides.

Fashion and leisurewear, particularly rainwear, require that the coated material is attractive with good drape and handle, be water repellent, although not necessarily for prolonged use in heavy rain, and that the fabric retain these properties after dry cleaning or laundering. There are several fabrics available that satisfy the conflicting requirements of waterproofness and breathability. One example is the laminated fabric known as Gore-Tex (W. L. Gore and Associates) which transmits perspiration through a microporous polytetrafluoroethylene (PTFE) film which is laminated between, usually, a woven nylon outer and a tricot inner fabric with a discontinuously applied adhesive. Another similarly qualified fabric, in the sense of waterproofness and breathability, is Entrant, which is a woven nylon fabric coated with a microporous polyurethane film formed by the so-called wet coagulation technique as in U.S. Pat. No. 4,429,000 to Toray Industries, Inc. Other polyurethane coated fabrics are described in U.S. Pat. No. 3,360,394 to Griffin. In the wet coagulation method a thin, microporous polyurethane layer is formed on a base fabric by applying a coating solution of a polyurethane dissolved in a polar organic solvent that will solubilize the polyurethane yet is miscible with water. The polymer solution is applied to the fabric substrate by knife coating or the like, then immersed in a bath of water which selectively dissolves or mixes with the organic solvent, exchanges water for the polar solvent and causes the previously dissolved polyurethane to coagulate leaving a thin, microporous coating having a cellular substructure on the fabric. Surface pores are generally one micron or less in diameter. Such pores are small enough to exclude water droplets and yet they provide a tortuous physical pathway from the base fabric to the coating surface, leading to a water-vapor-permeable fabric.

Rain-soaked and badly soiled garments must be cleaned or at least dried before long term storage to prevent proliferation of airborne bacteria and fungal spores that find a warm, moist environment hospitable. Such organisms find the cellular structure of this type of fabric attractive and can attack certain synthetic polymers, causing degradation of the polymer, in some cases, or at least permanent discoloration. Lomax, in the 1984 survey article Recent Developments in Coated Apparel, *Journal of Coated Fabrics*, Vol 14, October 1984, reports that natural rubber and some grades of PVC and polyurethane coatings have been protected by incorporated bacterocides and fungicides. In susceptible polymer coatings, biodegradation may be initiated in microscopic cracks and can eventually lead to delamination of the coating from the fabric and consequent loss of waterproofness.

The cellular structure of this type of microporous coating is subject to contamination with body oils, particularly when used as an article of apparel, due to direct contact with the skin or indirect transmission through a lining fabric. Thus, the potential exists for the production of undesirable odors, mildew and even discoloration since all the ingredients needed are present, namely, moisture, heat, and a nutrient for bacteria. It is also known that organic polymers are subject to bacterial attack which can result in deterioration of the polymer. A real need exists for the prevention of these undesirable occurrences.

The microporous coating of the present invention imparts to a microporous coated fabric the ability to prevent odor, discoloration, mildew, even discoloration due to bacterial growth. Furthermore, the coating retains its effectiveness even following repeated launderings.

BRIEF DESCRIPTION OF THE DRAWINGS

FIG. 1 is a schematic view of one arrangement for coating a fabric with an antimicrobial, moisture-permeable, water-repellant layer of polyurethane.

DETAILED DESCRIPTION OF THE INVENTION

It is well known that topical application of antimicrobial agents to textile fabrics, i.e. fabric finishes, can provide some degree of protection against bacterial growth. Most of these agents show a reduction of bacterial growth in a culture media when a treated fabric is immersed. The mechanism of bacterial reduction is by activity of the antimicrobial in solution, and this means that the antimicrobial must leach out from the treated fabric to be effective. To be effective, leaching is required, and when leaching occurs, the durability of the treatment must be finite since, eventually, it will become depleted.

It is also known that certain antimicrobial agents have the ability to chemically bond to fibers and retain their effectiveness over a long period of use One of these antimicrobial agents is 3-(trimethoxysilyl)-1-propyloctadecyldimethylammonium chloride, produced by Dow Corning Corporation and marketed under the name of DC-5700. Initially, a topical application of this material to a microporous coated fabric provided a durable, bacteriostatic product. This approach was tried with good results. However, since various types of fabrics that are coated require different amounts of coating to achieve desired properties, and in some cases this coating can be relatively thick, it was not known whether the topical treatment effectively permeated the entire coating. For these reasons it appeared that the most effective way to insure completeness of treatment with the antimicrobial agent would be to include it in the coating itself. Unfortunately, the improved bioactive compound is furnished by the supplier as a solution in methanol, which is not a solvent for polyurethane, the polymer used in many microporous coatings. Being a non-solvent, the methanol coagulated the polyurethane polymer when the bioactive compound, with its methanol solvent, was added to the coating solution. However, it was found by careful and proper technique that the bioactive compound could be first dissolved in N,N-dimethylformamide (DMF), a solvent for polyurethanes, and then incorporated into the coating solution. By first solving this coagulation/addition problem, it was then possible to produce a coagulated, microporous coating having an antimicrobial agent throughout the entire cellular matrix which would give maximum protection against bacterial growth, coupled with maximum durability. The result is that not only is the coating protected from undesirable bacterial growth but the fabric, being in such close proximity to the now bacteriostatic coating, is also rendered bacteriostatic. This finding does not preclude the possibilities in some cases of an additional treatment of the fabric itself either as a posttreatment finish or a pretreatment prior to coagulation, or treatment of the combined fabric and coating with the bioactive compound if a need arises. In fact, a treatment of coated fabric with the bioactive compound is effective; however, with the discovery of the ability to include the bioactive compound not merely on but in the coating a more complete and effective protection is provided.

An additional and unexpected benefit of the addition of the bioactive compound to the coating was that a softer product with better drape and hand was obtained as compared to the same coating applied to a fabric without the addition of the bioactive compound.

The coagulation process requires the water in the coagulation bath to exchange with the solvent in the coating solution, as explained above. Because methanol, as in the commercially available DC-5700, is completely water soluble, it was expected that this would influence the substantivity of the bioactive compound, i.e., that the bioactive compound would also be exchanged and removed with the coating solvent. Surprisingly, it has been discovered that the bioactive compound is actively bound to the coagulated microporous coating since the water coagulation bath following coating and coagulation, on analysis, did not reveal the presence of any bioactive compounds. This is substantiated by the results of multiple home launderings; while some loss of the bioactive compound occurs, the coated fabric remains bioactive. Even after 10 machine washings, bacterial growth is prevented, as explained in more detail in the evidence below.

The preferred bioactive, antimicrobial component of the coating composition is a member of the class of 3-(trimethoxysilyl)-1-propyloctadecyldimethylammonium chloride which is described in U.S. Pat. No. 3,730,701, the disclosure of which is hereby incorporated by reference. A class of suitable bioactive silyl quaternary ammonium compounds has the formula:

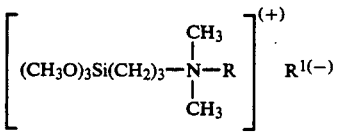

in which R is a $C_{11-22}$ alkyl group and $R^1$ is chlorine or bromine. The preferred silyl quaternary ammonium salt 3-(trismethoxysilyl)-1-propyloctadecyldimethylammonium chloride chloride and is available as a 42% active solids solution in methanol from Dow Corning Corporation of Midland, Mich., under the designation DC-5700. This material is well accepted in commerce and has the necessary U.S. regulatory approvals, not only as a bacteriostatic textile treatment, but also as a bactericidal component for medical device/non-drug applications.

The amount of the silyl quaternary ammonium bioactive material will be within the following limits the minimum amount is the quantity needed to achieve a specific minimum level of bioactivity, or to allow for process variations, if any, to maintain a specific predetermined level. The maximum amount will be limited by loss of substantivity on or in &he coating as evidenced by excessive wash- or leach-out during laundering or in use, or otherwise, and is balanced by the cost of this relatively expensive component. Best results are obtained when the silyl quaternary ammonium salt is present in an amount of from 0.01 to 10% by weight, calculated on the weight in the coating mix, and preferably in the range of 0.08% to 4% by weight similarly calculated.

Disclosed is a process for preparing a waterproof, water-vapor-permeable antimicrobial coated fabric, exhibiting a good hydrostatic pressure resistance, formed in a rapid and reproducible manner by coagulation from a solvent solution of a polyurethane elastomer. The fabric is coated using the wet coagulation method in which a polymeric elastomer, or mixture of polymeric elastomers, is dissolved in a water-miscible polar organic solvent. The polymer solution, to which a bioactive agent is added, is coated onto a base fabric and then immersed in a coagulation water bath. The water extracts the polar organic solvent, which is itself water-miscible, from the coating, leaving a porous, spongy polyurethane matrix having the specified porosity and other properties, on the base fabric. Washing to remove any unextracted polar organic solvent and drying follow. Optionally, a water repellent fluorocarbon finish is later applied. A convenient thickener system based on acrylic acid polymers that are compatible with the solvent/polyurethane system and soluble in the solvent may be used to control and adjust coating solution viscosity which, in turn, leads to thin, flexible polyurethane elastomer coatings having the optimum performance and customer acceptance properties. The thickener system is described in detail in copending, commonly assigned application Ser. No. 903,130 filed Sept. 3, 1986, now U.S. Pat. No. 4,707,400 the disclosure of which is hereby incorporated by reference.

The coating solutions of the present invention are based upon urethane resins dissolved in a water-miscible, polar solvent. A preferred series of polyurethane resins are Texthane 620C and 420C available from Morton Chemical division of Morton Thiokol. These are aromatic polyester urethane resins, 620C characterized as a soft resin and 420C as a firm resin; both are sold as DMF solutions whose physical and performance properties are as follows:

| | 620C | 420C |
|---|---|---|
| Dry Content (%) | 30 | 35 |
| Viscosity (max) cps. | 80,000 | 150,000 |
| Solvent | DMF | DMF |
| Tensile strength (kg/cm$^2$) | 600 | 600 |

-continued

| | 620C | 420C |
|---|---|---|
| 100% Modulus (kg/cm$^2$) | 80 | 100 |
| Elongation (%) | 550 | 400 |

Other components of the coating compositions include nonionic surfactants, such as the Pluronic polyols, which are surface active materials manufactured by BASF-Wyandotte and are block copolymers of propylene oxide and ethylene oxide. The polyoxypropylene serves as hydrophobe and the polyoxyethylene as lipophobe. As with the acrylic acid component, a mixture of two of these nonionic surfactant groups gives the best results. Average molecular weight for the Pluronic L-35 is 1900, with polyoxypropylene equal to 50 weight percent. Pluronic F-68 has an average molecular weight of 8350 with the polyoxypropylene equal to 20 weight percent.

The water-miscible polar organic solvent of choice is N,N-dimethylformamide, commonly referred to as DMF (CAS registry number 68-12-2), although other compatible solvents such as dimethylacetamide or dimethylsulfoxide may be considered.

An amine is preferably added to neutralize the polyacrylic acid resin and several amines may be useful; however, best results were obtained with di(2-ethylhexyl)amine optionally combined with polyoxyethylene (15) octadecylamine (available as Ethomeen C/25 from Armak Chemicals Division of Akzo Chemie America).

Ranges and amounts of ingredients: Each of the above-named components is included in the water-coagulable coating compositions as follows:

| | |
|---|---|
| Urethane resin(s) | Up to 48% |
| Nonionic surfactant(s) | Up to 8% |
| Water | Up to 6% |
| Antimicrobial | Up to 4% |
| Water-miscible polar organic solvent | Balance |

It will be understood that the coating composition may contain any of the usual coating additives and adjuvants, such as a pigment or colorant, water repellent, antistat, etc. The quantities of each of these ingredients may be varied depending upon the result desired, for instance depending on the coating viscosity and total solids requirements. Each of the above-listed ingredients must be present in the minimum amount indicated or, if an optional ingredient, must be present in an amount of at least 0.1%. All parts and percentages herein are expressed by weight unless otherwise indicated.

Performance requirements for urethane-coated fabrics will vary depending upon the application or end use to which the fabric is exposed. As a point of reference, and without particular limitation, a typical urethane-coated nylon taffeta for use in constructing rainwear will have the following minimum values:

| | |
|---|---|
| Moisture vapor transmission rate (g/m$^2$/24 hours) | 800 (ASTM E-96A) |
| Hydrostatic pressure resistance (psi) | 10 |
| Coating weight (oz/yd$^2$) | 0.3 |

The coating formulation was prepared as follows: the urethane resin or mixture of resins is preweighed into a container. Water, the polar organic solvent, usually DMF, the surfactant, and the antimicrobial are preweighed into a separate container and mixed thoroughly. The water/solvent mixture is then added to the urethane under agitation. Care is taken not to mix the antimicrobial in its methanol solution with the urethane prior to diluting the antimicrobial with the polar solvent (DMF), otherwise coagulation is expected to occur. The optimum procedure for mixing of ingredients and order of mixing will be determined through a brief series of small-scale experiments, care being taken to avoid premature coagulation of the coating solution.

Once the coating solution is prepared, the urethane coating is applied to any textile substrate capable of supporting the liquid film by any conventional coating method as is appropriate for use in the wet coagulation method. The coated fabric is then dipped in a coagulation bath consisting of water, or water and an additive to alter coagulation rate, e.g. DMF; surfactant, etc. During the coagulation step the majority of the DMF in the DMF/urethane film migrates into the coagulation bath and is replaced by water, generating a microporous, spongy film on the fabric surface. After additional washing to remove all the DMF, the fabric is dried and given an optional water repellent finish.

The process is illustrated in more detail in FIG. 1 in which the fabric 1 to be coated is taken from a fabric supply 2, and passed, via a series of feed rolls 3, to a knife-over-roll coater 4 which applies the coating solution from a supply tank (not shown). The coated fabric is then led in the "wet" condition to a coagulation tank 5 filled with water 6 or water-enhanced liquid where a major portion of the DMF is replaced with water leaving a coherent, tenacious, spongy, microporous film 7 on the fabric. The coated fabric is squeezed through a set of rolls 8, then led to a saturator 9 filled with water to remove additional quantities of DMF, then skyed and accumulated at 10, directed to a series of wash boxes 11 where the coated fabric is washed with water, then squeezed through a pair of rollers 12 (not shown) and dried. Arrangements consistent with the wet coagulation technique in addition to that depicted in FIG. 1 may be used.

EXAMPLE

A coating mixture was prepared containing two urethane resins, a nonionic surfactant and other diluents according to the mixing instructions given above and having the following formulation:

| | amount (wt %) |
|---|---|
| urethane resin (Texthane 620-C) | 29.7 |
| urethane resin (Texthane 420-C) | 25.4 |
| nonionic surfactant (Pluronic L-35) | 2.0 |
| DMF | 40.9 |
| water | 2.0 |

Total solids was 19.8%. To this solution various amounts of the bioactive silyl quaternary ammonium compound was added ranging from none (sample H) and from 0.2% to 0.6% (samples A through F) calculated on the weight of the overall solution. In addition, an afterfinish of 0.4% of the bioactive silyl quaternary ammonium was applied to samples also containing the bioactive compound in the urethane coating (D,E,F)

and to a sample with no bioactive compound in the finish (G). The solutions and finishes were coated onto a 100% polyester woven fabric. For purposes of comparison two commercially available vapor-permeable, water-repellent fabrics, Entrant and GoreTex, were evaluated.

All samples were evaluated for bacterial reduction and mildew coverage measured according to Dow Corning Corporate Test Method 0923 and modified A.A.T.C.C. Test Method 30 procedures, respectively, and the results were as follows:

| Sample | % Bioactive cpd in Coating | % Bioactive cpd in Finish | % Bacterial Reduction | | % Mildew Coverage | |
|---|---|---|---|---|---|---|
| | | | Original | 10 MW* | Original | 10 MW* |
| A | 0.2 | — | 58.8 | 0 | 30 | 30 |
| B | 0.4 | — | 62.7 | 1.6 | 10 | 20 |
| C | 0.6 | — | 97.4 | 100 | 0 | 10 |
| D | 0.2 | 0.4 | 100 | 0 | 10 | 10 |
| E | 0.4 | 0.4 | 100 | 4.7 | 10 | 10 |
| F | 0.6 | 0.4 | 99.9+ | 3.3 | 10 | 10 |
| G | — | 0.4 | 99.9 | 0 | 90 | 75 |
| H | — | — | 0 | | 90 | |
| Entrant | | | 0 | | 90 | |
| Goretex | | | 0 | | 90 | |

*machine washings

The results show that the % bacterial reduction is quite high on the original (unlaundered) samples. After ten machine washings (MW), the % bacterial reduction is generally low, but bacterial growth is prevented. That is, the coated fabric has bacteriostatic properties. In sample F (0.6% of bioactive compound in the coating), there was 100% reduction of bacteria; that is, the sample had bacteriocidal properties. In general, the treatments also reduced the growth of mildew substantially in comparison with untreated fabric, Gore-Tex or Entrant.

What is claimed is:

1. A process of making a waterproof, water-vapor-permeable, antimicrobial coated fabric having a durable, antimicrobial, microporous polyurethane layer thereon formed by the wet coagulation method, said process comprising applying a water-miscible, polar organic solvent solution of a polyurethane elastomer to a base fabric, immersing the thus-coated base fabric into an aqueous coagulation bath to extract the solvent from the polymer solution leaving a porous polyurethane matrix adhered to the base fabric, then washing and drying the coated fabric, wherein the polyurethane elastomer solution contains a bioactive amount of a bioactive silyl quaternary ammonium compound of the formula:

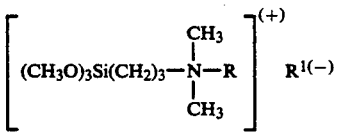

wherein R is an alkyl of 11 to 22 carbon atoms and $R^1$ is bromine or chlorine, the resulting coated fabric having a moisture vapor transmission of at least 800 $g/m^2/24$ hours and a hydrostatic pressure resistance of at least 10 psi.

2. The process of claim 1 in which from about 0.01 to about 10 weight percent of the bioactive compound is present in the solution.

3. The process of claim 2 in which from about 0.08 to about 4.0 weight percent of the bioactive compound is present in the solution.

4. A waterproof, water-vapor-permeable, antimicrobial coated fabric resistant to the spread of mildew, produced by the process of claim 1.

5. A process of preparing a polyurethane-based coating solution for application to a fabric substrate to form a rainproof, water-vapor-permeable coated fabric with durable antimicrobial properties, a moisture-vapor transmission of at least 800 $g/m^2/24$ hours, and a hydrostatic pressure resistance of at least 10 psi, said process comprising the sequential steps of:

(a) mixing together a methanol solution of a bioactive silyl quaternary ammonium compound of the formula:

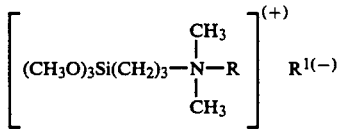

wherein R is an alkyl of 11 to 22 carbon atoms and $R^1$ is bromine or chlorine, with N,N-dimethylformamide and a surfactant to form a first solution;

(b) preparing a solution of at least one polyurethane resin in a water-miscible, compatible liquid vehicle; and (c) combining the solutions of steps (a) and (b) to form a water-coagulable, polyurethane-based, bioactive coating composition for application to fabric substrates via the wet coagulation method to make microporous, rainproof, water vapor-permeable antimicrobial coated fabrics resistant to the spread of mildew.

6. The product produced by the process of claim 5, wherein the durable antimicrobial properties are characterized by a retention of at least 50% of the original bioactivity after 10 launderings.

* * * * *